US009570852B2

(12) United States Patent
Plamondon et al.

(10) Patent No.: US 9,570,852 B2
(45) Date of Patent: Feb. 14, 2017

(54) NETWORK PLUG

(71) Applicant: BELDEN CANADA INC., Saint-Laurent (CA)

(72) Inventors: Jean-Sébastien Plamondon, Laval (CA); Vincent Pilon, Montreal (CA)

(73) Assignee: BELDEN CANADA INC., Saint-Laurent (CA)

( * ) Notice: Subject to any disclaimer, the term of this patent is extended or adjusted under 35 U.S.C. 154(b) by 0 days.

(21) Appl. No.: 15/141,173

(22) Filed: Apr. 28, 2016

(65) Prior Publication Data

US 2016/0322750 A1 Nov. 3, 2016

Related U.S. Application Data

(60) Provisional application No. 62/154,294, filed on Apr. 29, 2015.

(51) Int. Cl.

| | |
|---|---|
| ***H01R 13/627*** | (2006.01) |
| ***H01R 13/633*** | (2006.01) |
| ***H01R 24/64*** | (2011.01) |
| *H01R 107/00* | (2006.01) |

(52) U.S. Cl.
CPC ..... *H01R 13/6335* (2013.01); *H01R 13/6272* (2013.01); *H01R 24/64* (2013.01); *H01R 2107/00* (2013.01)

(58) Field of Classification Search
CPC ..... H01R 13/6271; H01R 13/6275
USPC ..... 439/344, 352
See application file for complete search history.

(56) References Cited

U.S. PATENT DOCUMENTS

| | | | | |
|---|---|---|---|---|
| 6,174,190 | B1 | 1/2001 | Tharp et al. | |
| 7,297,013 | B2 * | 11/2007 | Caveney | H01R 43/26 439/352 |
| 7,588,373 | B1 * | 9/2009 | Sato | G02B 6/3893 385/53 |
| 8,632,352 | B2 * | 1/2014 | Wagner | H01R 13/5812 439/352 |
| 8,747,141 | B2 * | 6/2014 | Crain | H01R 13/633 439/352 |
| 8,979,569 | B2 * | 3/2015 | Aekins | H01R 13/633 439/352 |

(Continued)

OTHER PUBLICATIONS

International Search Report of corresponding application No. PCT/CA2016/050491.

*Primary Examiner* — Phuong Dinh
(74) *Attorney, Agent, or Firm* — Hugh Mansfield

(57) ABSTRACT

A network plug terminating a cable and configured for mating with a socket, and comprising a plurality of terminal contacts disposed along a forward face thereof, each of the terminal contacts terminating a respective one of a plurality of twisted pairs of conductors and such that when the plug is inserted into the socket each of the terminal contacts comes into contact with a respective tine in the socket. The plug further comprises a flexible tab comprising a tab release member and a slider connected to the tab release member. The slider is configured for movement along a length of the plug against a biasing force between a first position, wherein the flexible tab is in an unflexed state and engageable by a tab engaging feature in the socket and a second position wherein the flexible tab is in a flexed state and not engageable by the tab engaging feature.

11 Claims, 8 Drawing Sheets

(56) References Cited

U.S. PATENT DOCUMENTS

| | | | | |
|---|---|---|---|---|
| 2004/0247252 | A1* | 12/2004 | Ehrenreich | G02B 6/3893<br>385/58 |
| 2013/0189871 | A1* | 7/2013 | Crain | H01R 13/633<br>439/352 |

* cited by examiner

NETWORK PLUG

CROSS REFERENCE TO RELATED APPLICATIONS

This application claims benefit, under 35 U.S.C. §119(e), of U.S. provisional application Ser. No. 62/154,294, filed on Apr. 29, 2015, incorporated herein in its entirety by reference.

FIELD OF THE INVENTION

The present invention relates to a network plug. In particular, the present invention relates to a network plug for use in high density applications.

BACKGROUND OF THE INVENTION

The prior art reveals network plugs terminating cables and configured for insertion into sockets disposed in patch panels or the like. Such plugs typically comprise a tab which must be depressed in order to release a plug from a socket into which. Although insertion of a plug into a socket in most configurations is straightforward, on high density versions of such panels the inventors have noted that removal of plugs previously inserted into sockets can be difficult, as the tabs cannot be easily accessed due to the obstruction posed by other plugs and their respective cables.

The prior art also discloses tools which can be inserted to aid in accessing tabs such that the plugs can be removed from their respective sockets. Such tools, however, are cumbersome and easily lost.

SUMMARY OF THE INVENTION

In order to address the above and other drawbacks, there is provided a network plug for interconnecting a plurality of twisted pairs of conductors of a cable with respective conductive tines disposed within a socket comprising a tab engaging feature. The plug comprises an elongate housing comprising a first housing end configured for receiving the cable, a second housing end opposite the first housing end and configured for mating with the socket, the second housing end comprising a plurality of terminal contacts disposed along a forward face thereof, each of the terminal contacts terminating a respective one of the twisted pairs of conductors and such that when the second housing end is inserted into the socket each of the terminal contacts comes into contact with a respective one of the tines, a flexible tab attached to the housing towards the second housing end and comprising a tab release member, and a slider connected at a first slider end to the tab release member, the slider configured for movement along a length of the housing away from the second housing end against a biasing force between a first position, wherein the flexible tab is in an unflexed state and engageable by the tab engaging feature and a second position wherein the flexible tab is in a flexed state and not engageable by the tab engaging feature.

There is also disclosed a network cable connectable with a socket comprising a tab engaging feature and a plurality of conductive tines disposed therein. The cable comprises a plurality of twisted pairs of conductors, a cable jacket surrounding the plurality of pairs of conductors, an elongate housing comprising a first housing end, a second housing end opposite the first housing end and configured for mating with the socket, the second housing end comprising a plurality of terminal contacts disposed along a forward face thereof, each of the terminal contacts terminating a respective one of the twisted pairs of conductors and such that when the second housing end is inserted into the socket each of the terminal contacts comes into contact with a respective one of the tines, a flexible tab attached to the housing towards the second housing end and comprising a tab release member, and a slider connected at a first slider end to the tab release member, the slider configured for movement along a length of the housing away from the second housing end against a biasing force between a first position, wherein the flexible tab is in an unflexed state and engageable by the tab engaging feature and a second position wherein the flexible tab is in a flexed state and not engageable by the tab engaging feature.

DETAILED DESCRIPTION OF THE ILLUSTRATIVE EMBODIMENTS

Figure 1:
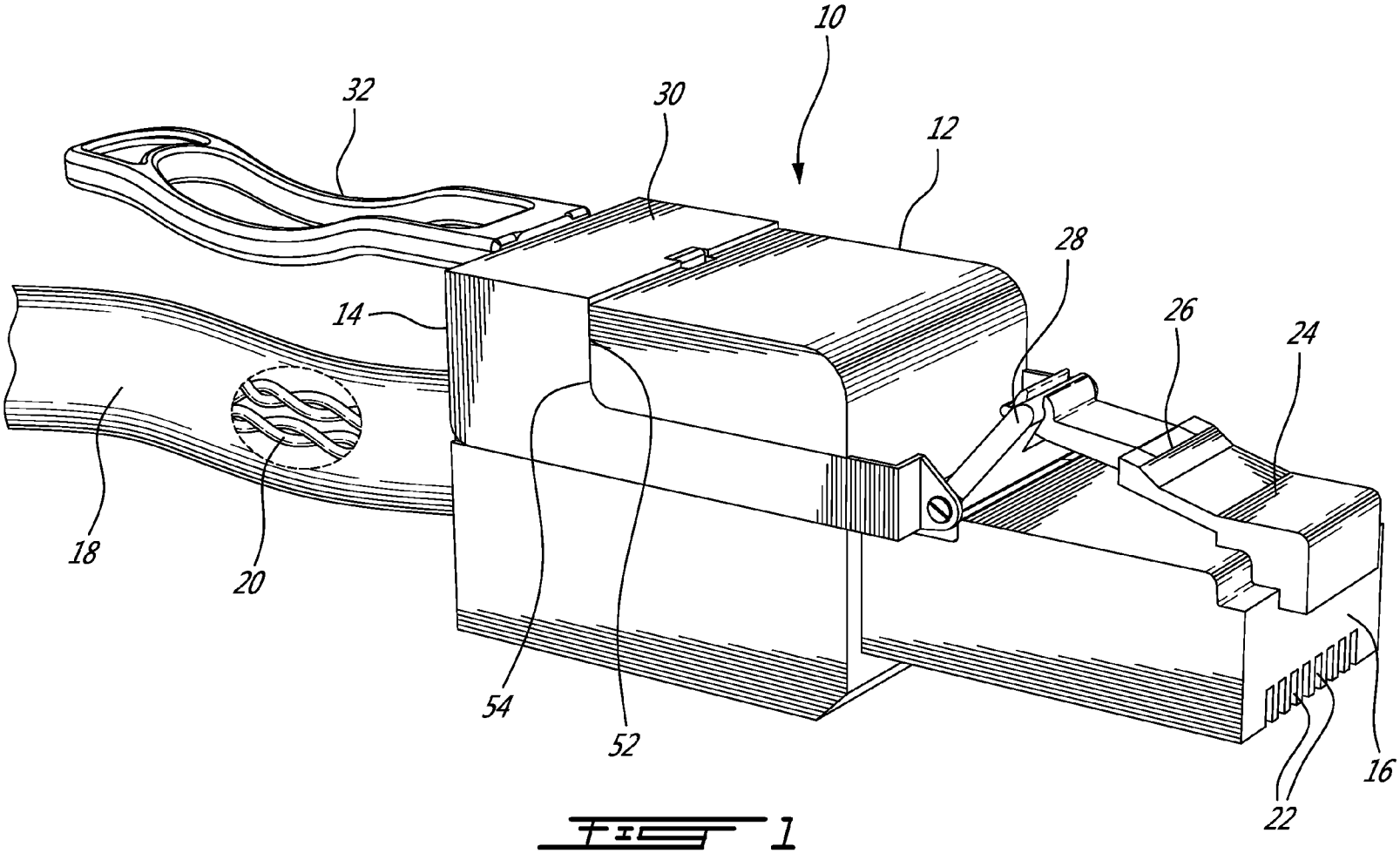
FIG. 1 is a raised left front perspective view of a network plug in accordance with an illustrative embodiment of the present invention.

Referring now to FIG. 1, a network plug in accordance with an illustrative embodiment of the present invention, and generally referred to using the reference numeral 10, will now be described. The network plug 10, illustratively an RJ-45 compatible type plug, comprises an elongate housing 12 and a first end 14 and second end 16. The plug illustratively terminates, at the first end 14, a cable 18 comprised of four (4) twisted pairs of conductors 20. Each of the conductors 20 is interconnected with a respective one of a plurality of terminal contacts as in 22 exposed along said second end 16. The plug 10 further comprises a flexible socket engaging tab 24 comprising a tab release member 26, a link means 28 attached between the slider 30 and the tab release member 26 for actuating the tab release member 26, a slider 30 and a pull tab 32.

Figure 2:
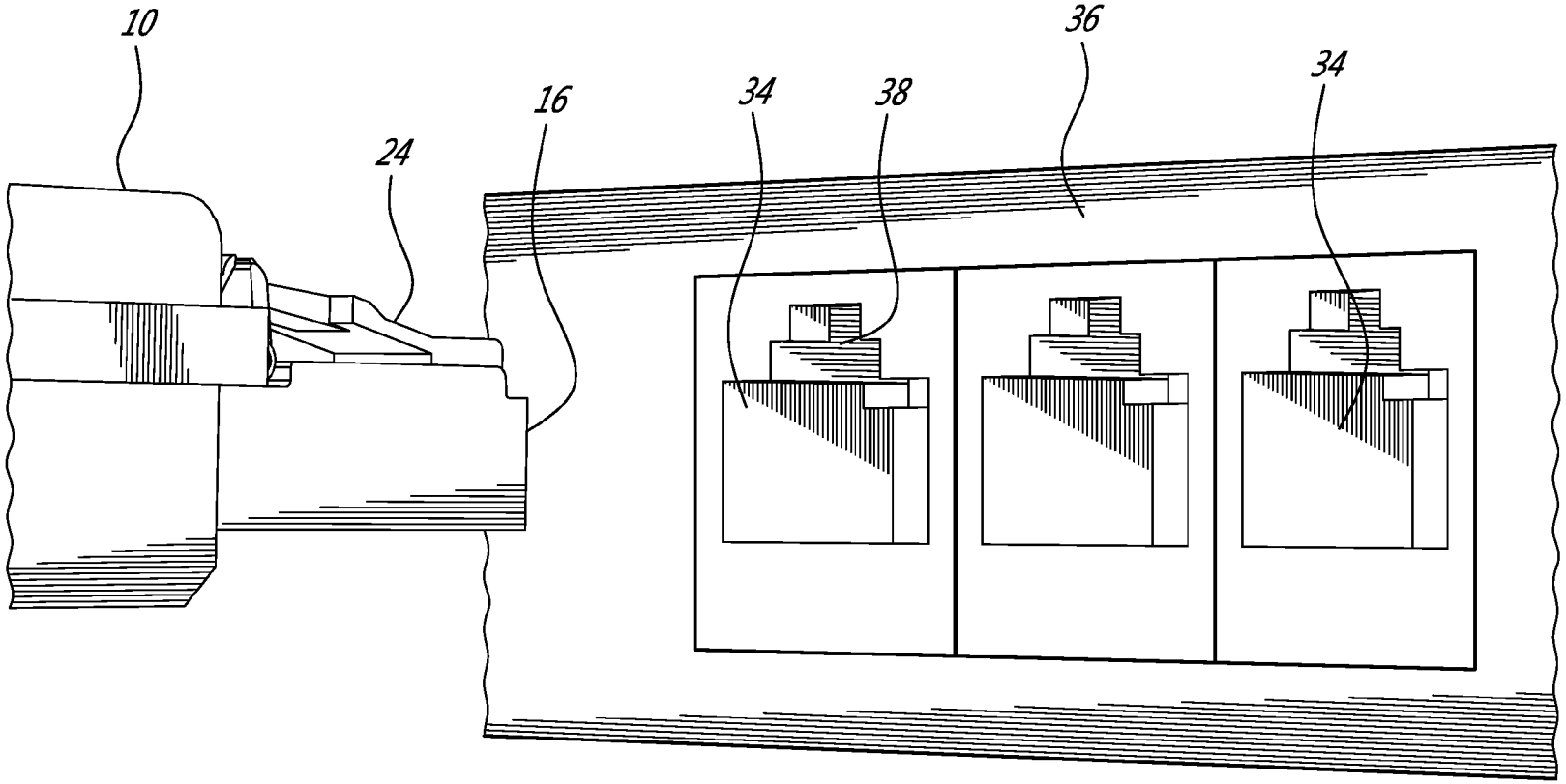
FIG. 2 is a rear left perspective view of a network plug in accordance with an illustrative embodiment of the present invention and a socket.

Referring now to FIG. 2, the second end 16 of the plug 10 provides a complementary match to a socket as in 34, illustratively mounted in a patch panel 36, wall plate or the like, and such that the second end 16 can be inserted into the socket 34 thereby mating the plug 10 to the socket 34, and such that the terminal contacts 22 come into contact with respective ones of a plurality of tines (not shown) disposed within the socket 34. On insertion of the second end 16 into the socket 34, the flexible tab 24 engages a tab engaging feature 38 moulded or otherwise formed in the socket 34, thereby removeably securing the plug housing 12 to the socket 34.

Figure 3:
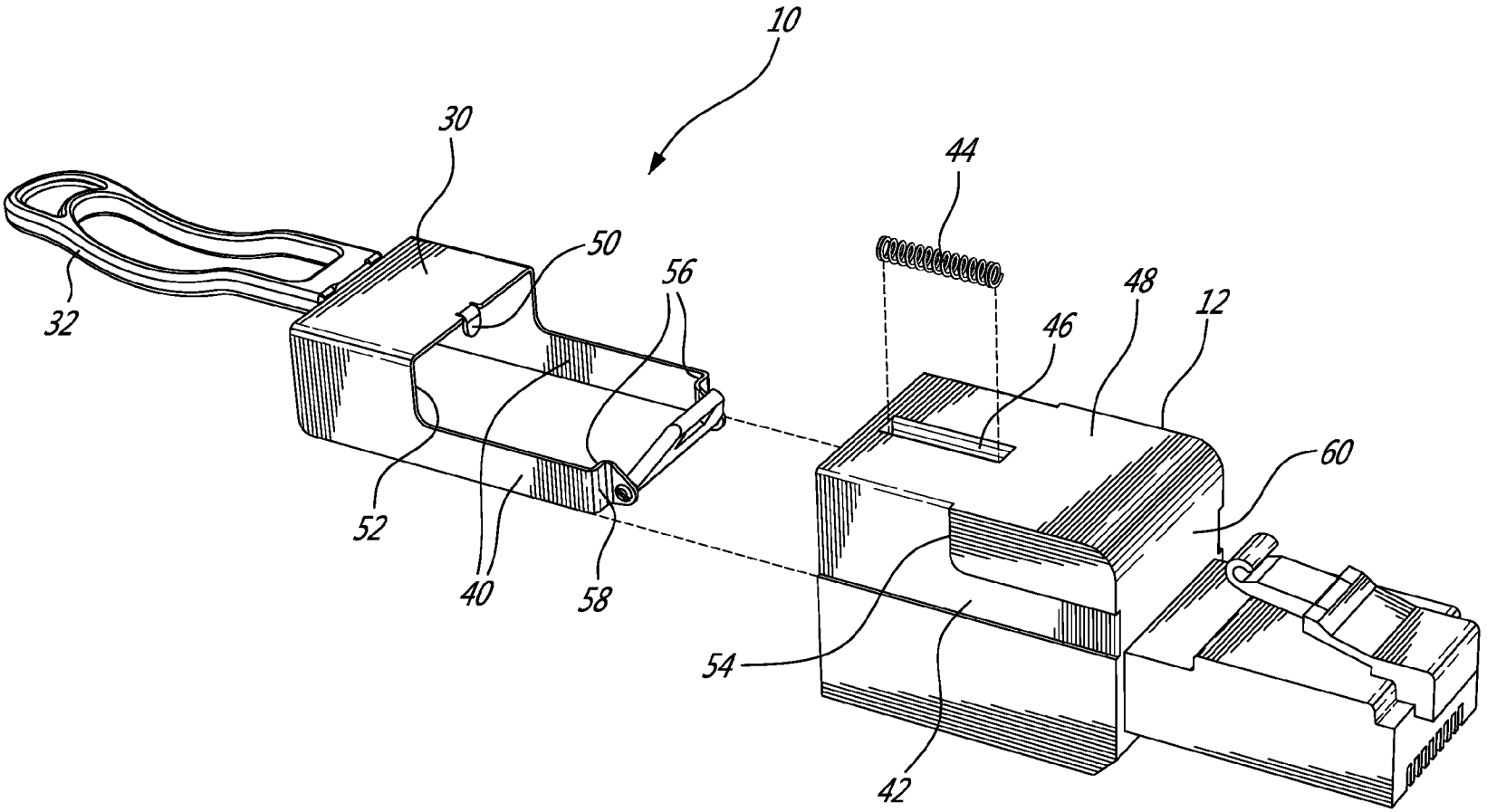
FIG. 3 is an exploded raised left front perspective view of a network plug in accordance with an illustrative embodiment of the present invention.

Referring now to FIG. 3, the slider 30 comprises a pair of opposed rails as in 40 which are slideably engaged within respective channels 42 moulded or otherwise formed in the housing 12. A spring 44 is mounted in a slot 46 moulded or otherwise formed in a top surface 48 and is engaged by a finger 50 depending from the underside of the slider 30. The spring 44 biases the finger 50 and therefore the slider 30 forward such that in a first (normal) position, and as shown in FIG. 1, a front edge 52 of the slider 30 rests against the raised side 54 of the channel 42.

Figure 4:
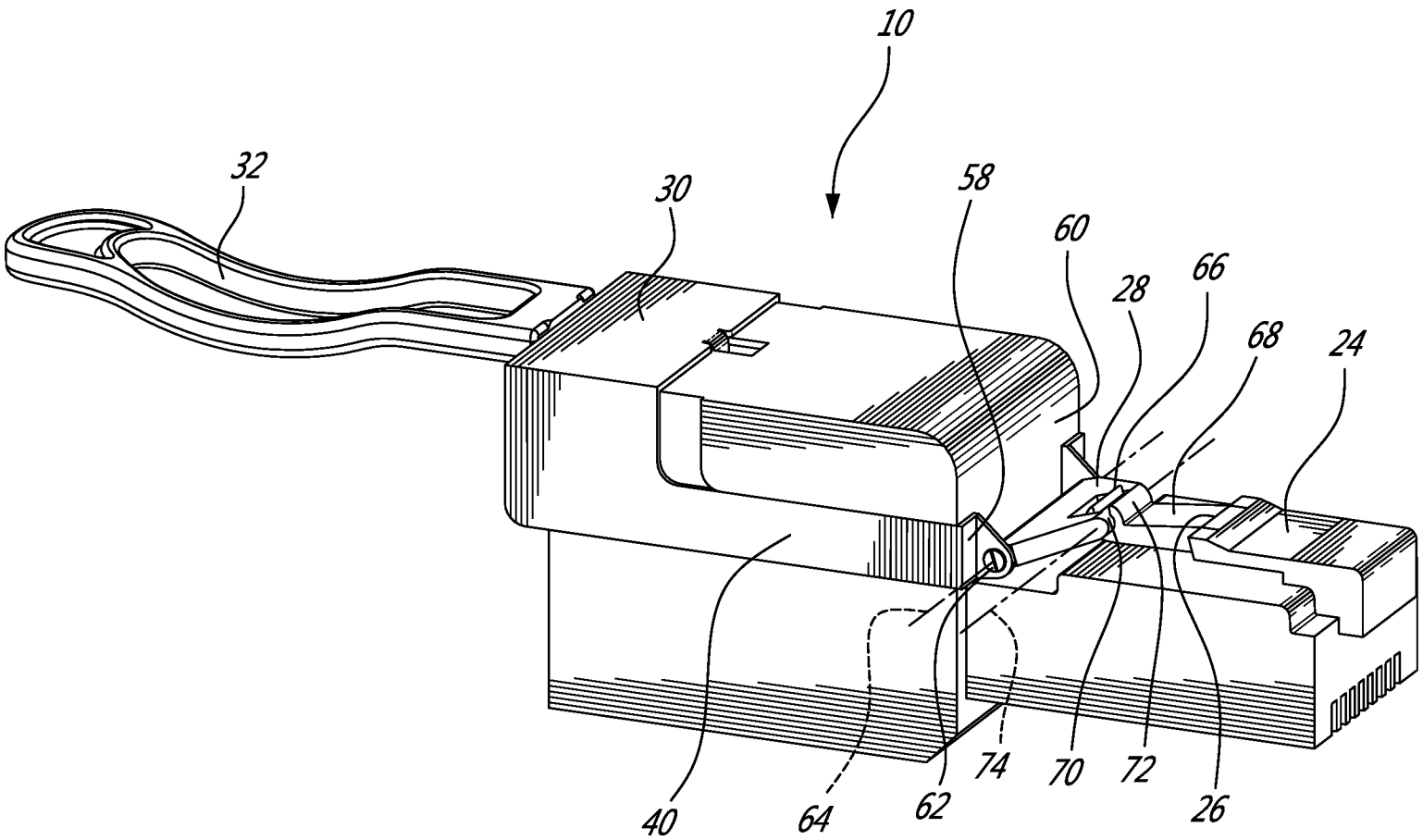
FIG. 4 is a raised left front perspective view of a network plug in accordance with an illustrative embodiment of the present invention in a second disengaged position.

Referring to FIG. 4 in addition to FIG. 3, the rails 40 can be slid rearward in their channels 42 and bringing the slider 30 to a second position by pulling on the pull tab 32 until the inner surfaces 56 of the forward ends 58 of the rails are engaged by a forward surface 60 of the housing 12. Movement of the forward ends 58 rearward increases the distance between the base of the link means 28 and the second end 16, causing a first end 62 of the link means 28 to rotate relative to a first transverse axis 64. Illustratively, the link means 28 comprises a first link part 66 hingedly interconnected with a tab release member 68. As illustrated, the interconnection between the first link part 66 and the tab release member 68 comprises an axle 70 on the first link part 66 which is snap-fit into a receiving slot 72 in the tab release member 68, and such that the first link part 66 can rotate relative to the tab release member 68 about a second transverse axis 74. The tab release member 68 is in turn connected to the flexible end 26. Also as illustrated, rotation of the link means 28 relative to the first transverse axis 64 causes the first link part 66 and the tab release member 68 to rotate relative to one another about the second transverse axis 74, thereby actuating the flexible end 26 of the socket engaging tab 24.

Referring back to FIG. 1 in addition to FIGS. 3 and 4, on release of the pull tab 32 the spring 44 biases the slider 30 forward such that it returns to the first position.

Figure 5:
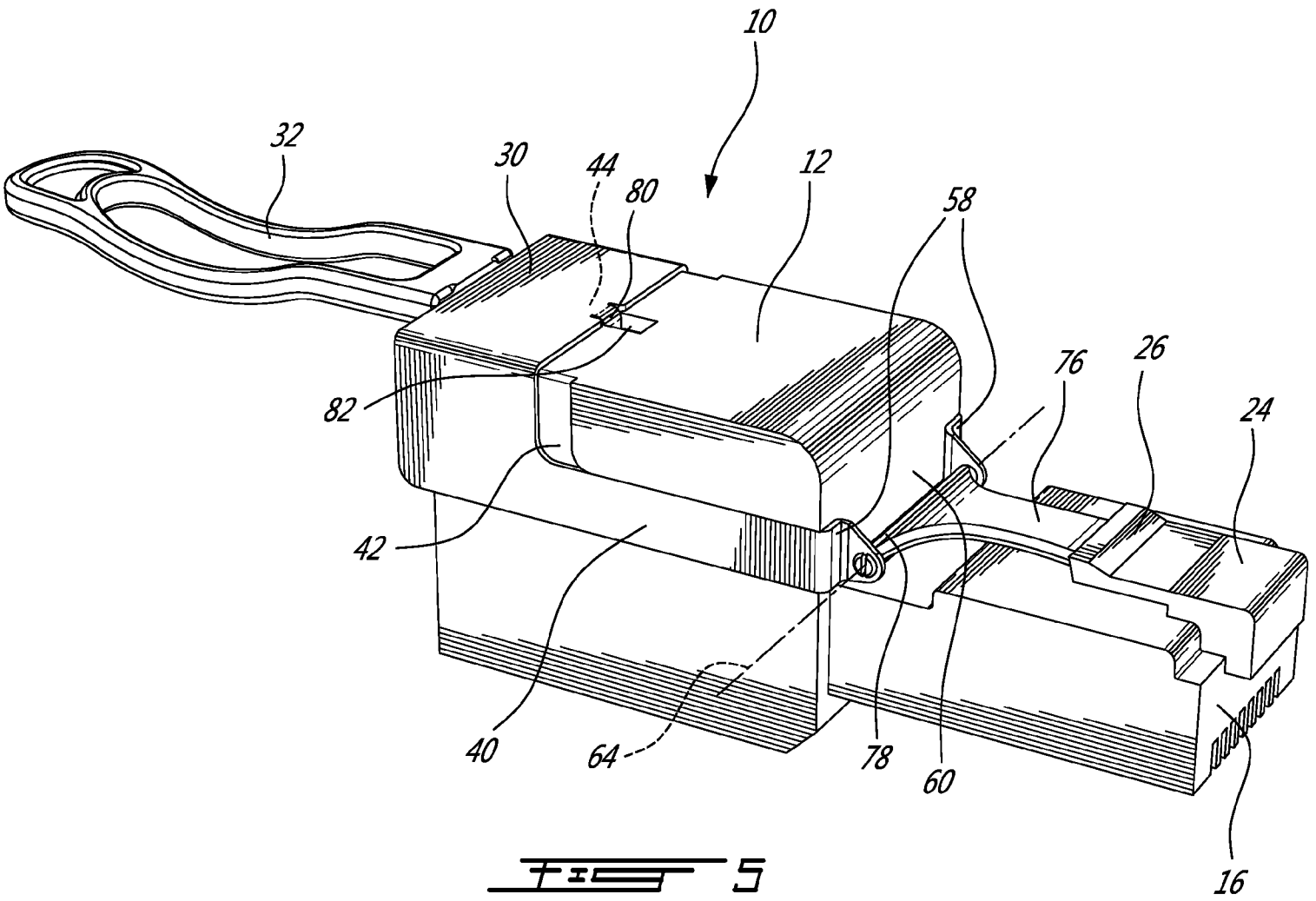
FIG. 5 is a raised left front perspective view of a network plug in accordance with a first alternative illustrative embodiment of the present invention in a second disengaged position.

Referring now to FIG. 5 in addition to FIG. 4, in a first alternative illustrative embodiment of the plug 10, the first link part 66 and the tab release member 68 of the link means 28 is replaced by a flexible tab release member 76. A first end 78 of the flexible tab release member 76 is connected between the ends 58 of the rails and free to pivot about the first transverse axis 64. As discussed in respect to FIG. 4, the rails 40 can be slid rearward in their channels 42 and the slider 30 brought to a second position by pulling on the pull tab 32 until the inner surfaces 56 of the forward ends 58 of the rails are engaged by a forward surface 60 of the housing 12. Movement of the forward ends 58 rearward increases the distance between the first end 78 of the flexible tab release member 76 and the second end 16, causing the first end 78 to rotate about the first transverse axis 64 and the flexible tab release member 76 to flatten. Flattening the flexible tab release member 76 in turn actuates the flexible end 26 of the socket engaging tab 24, thereby disengaging the plug from the socket. On pulling on the pull tab 32, a finger 80 on the underside of the slider 30 compresses a spring 44 under the slider 30 and held in a slot 82 moulded or otherwise formed in an upper surface of the housing 12 and such that, on release of the pull tab 32, the spring 44 biases the finger 80 in the slider 30 forward such that the slider 30 returns to the first position.

Figure 6A:
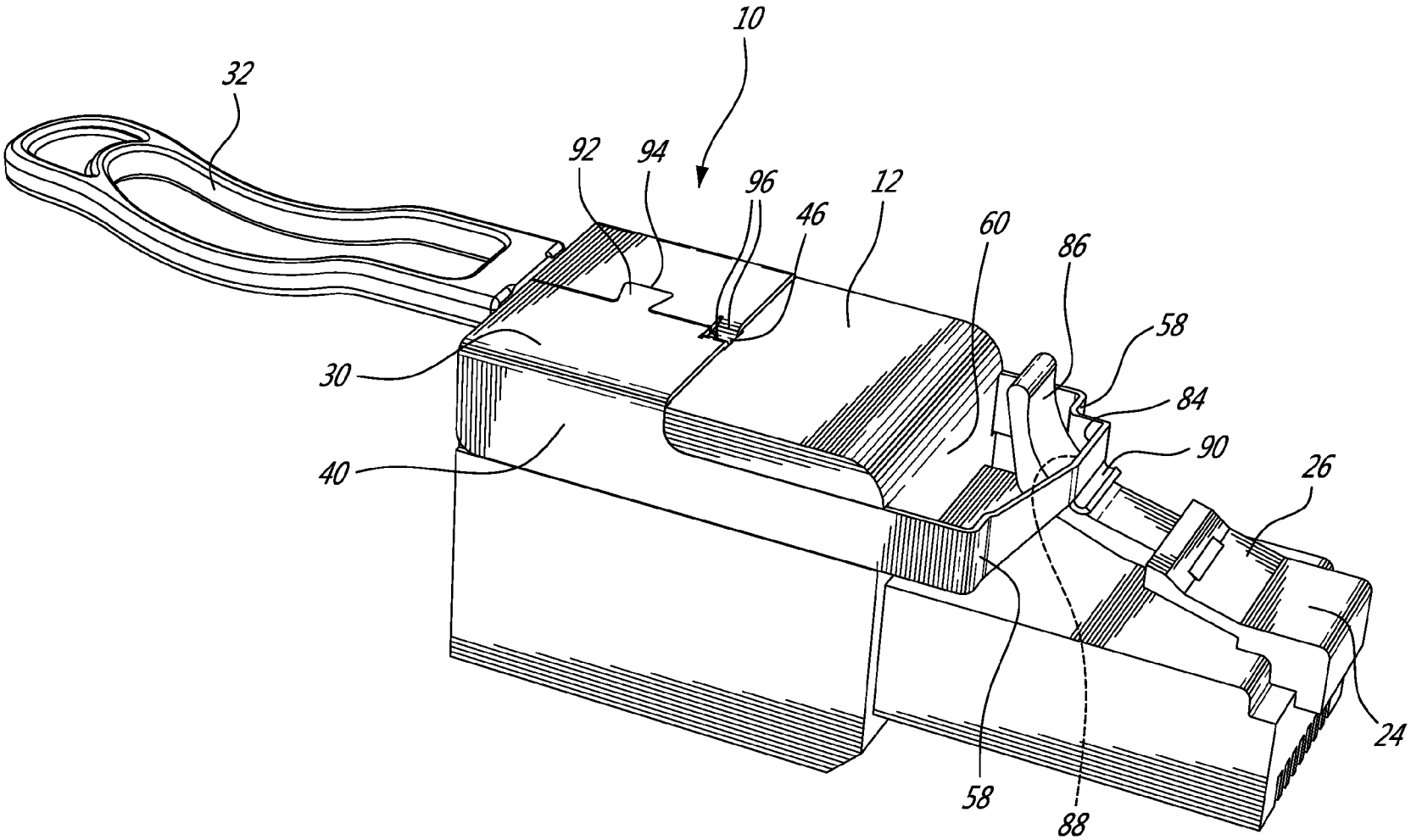
FIG. 6A is a raised left front perspective view of a network plug in accordance with a second alternative illustrative embodiment of the present invention in a first engaged position.

Referring now to FIG. 6A, in a second alternative illustrative embodiment of the plug 10, the front ends 58 of the rails 40 are interconnected by a cross brace 84 such that in a first position the cross brace 84 is spaced from the forward surface 60 of the housing 12. An extended tab release member 86 is attached to the end of the flexible end 26 of the tab 24 extending under the cross brace 84 curving upwards and such that the extended tab release member 86 is positioned adjacent an inner surface 88 of the cross brace 84. The flexible end 26 and extended tab release member 86 are biased upward and such that the extended tab release member 86 biases the cross brace 84 forward away from the forward surface 60 of the housing 12. In this regard, the cross brace 84 includes a curved lip 90 to reduce friction between the inner surface 88 of the cross brace 84 and the extended tab release member 86, allowing the inner surface 88 and the extended tab release member 86 to slide relative to one another.

Still referring to FIG. 6A, the slider 30 is of one piece construction and illustratively stamped from a stainless steel sheet or the like. In order to ensure that the rails 40 remain equally spaced during installation and use, a tab 92 is received by a matched slot 94. A pair of fingers as in 96 are also provided which depend into the slot 46.

Figure 6B:
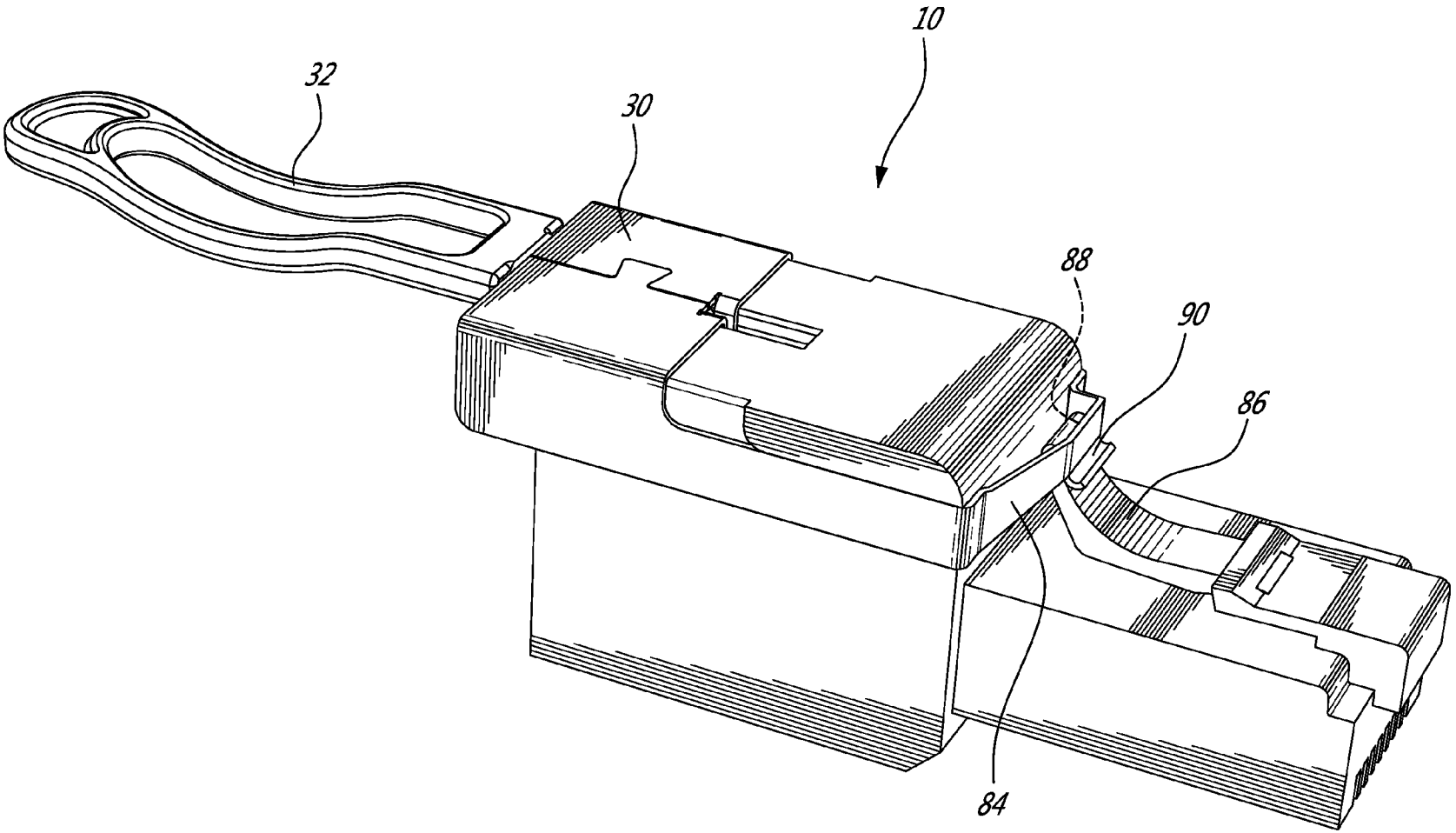
FIG. 6B is a raised left front perspective view of the network plug in FIG. 6A in a second disengaged position.

Referring now to FIG. 6B in addition to FIG. 6A, by pulling on the pull tab 32 the slider 30 can be moved from the first position (FIG. 6A) to the second position (FIG. 6B) and such that the inner surface 88 and curved lip 90 of the cross brace 84 exerts a force on the extended tab release member 86, causing the flexible end 26 of the tab 24 to move downwards, thereby disengaging the plug 10 from a socket, if secured therein. Subsequent release of the pull tab 32 releases the force exerted on the extended tab release member 86 by the inner surface 88 and curved lip 90 of the cross brace 84, allowing the extended tab release member 86 to return to its normal position coincident with the slider 30 moving from the second position back to the first position.

Figure 7:
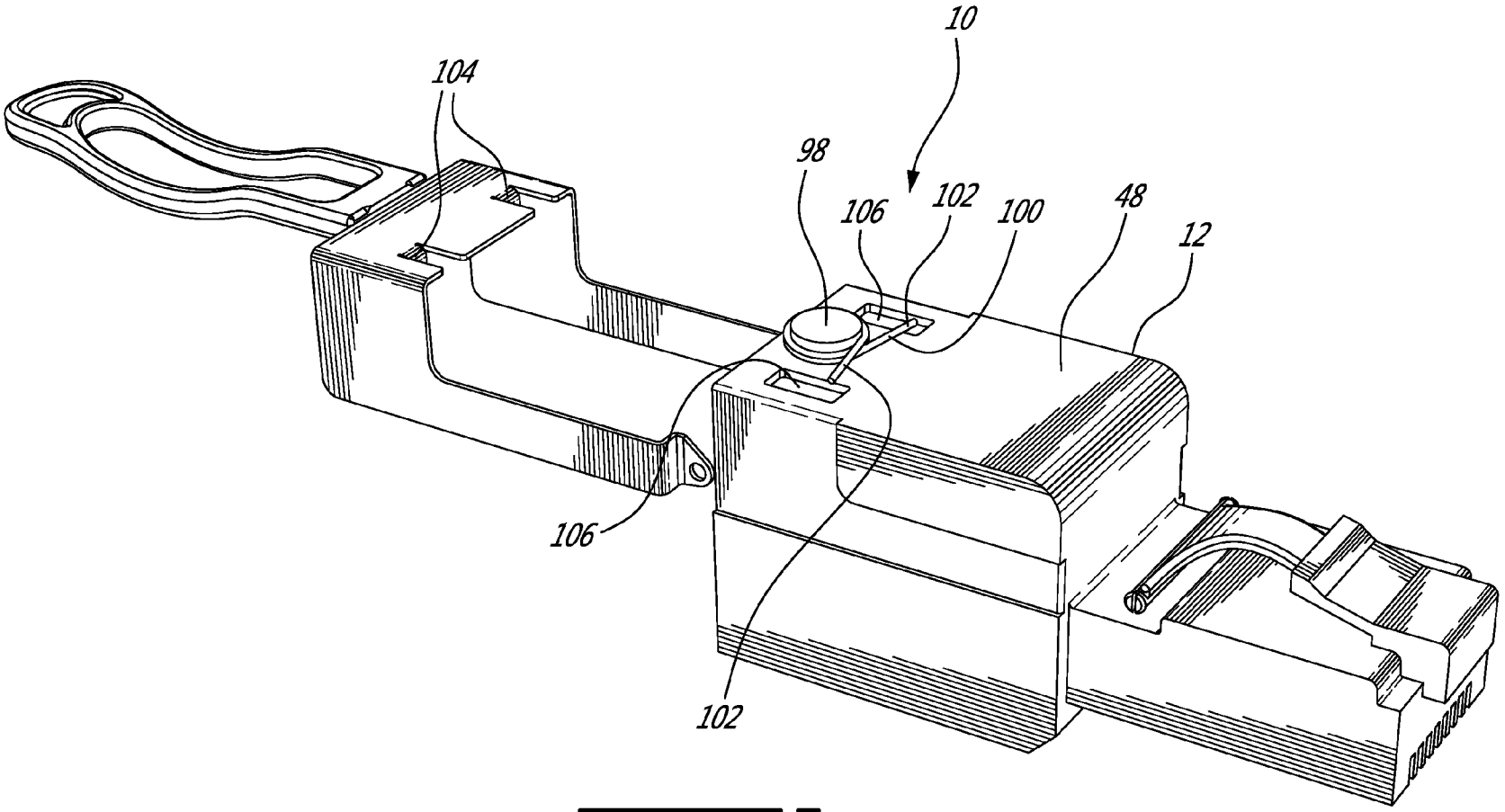
FIG. 7 is a partially exploded raised left front perspective view of a network plug in accordance with a third alternative illustrative embodiment of the present invention.

Referring now to FIG. 7, in a third alternative embodiment of the plug 10, a means for biasing the slider 30 into the first position is provided comprising a raised cylindrical boss 98 on and having an axis perpendicular to the upper surface 48 of the housing 12 and about which a spring 100 is concentrically wound. The ends 102 of the spring 100 engage fingers 104 formed in the slider and such that, as the slider 30 is moved from the first position to the second position, for example by pulling on the pull tab 32, the ends 102 of the spring 100 exert a force on the fingers 104, and such that on release of the pull tab 32, the slider 30 returns to the first position. Slots 106 are moulded in the upper surface 48 of the housing 28 and into which the fingers 104 depend.

Although the present invention has been described herein above by way of specific embodiments thereof, it can be modified without departing from the spirit and nature of the subject invention as defined in the appended claims.

We claim:

1. A network plug for interconnecting a plurality of twisted pairs of conductors of a cable with respective conductive tines disposed within a socket comprising a tab engaging feature, the plug comprising:

an elongate housing comprising a first housing end configured for receiving the cable, a second housing end opposite said first housing end and configured for mating with the socket, said second housing end comprising a plurality of terminal contacts disposed along a forward face thereof, each of said terminal contacts terminating a respective one of the twisted pairs of conductors and such that when said second housing end is inserted into said socket each of said terminal contacts comes into contact with a respective one of the tines;

a flexible tab attached to said housing towards said second housing end and comprising a tab release member; and a slider connected at a first slider end to said tab release member, said slider configured for movement along a length of said housing away from said second housing end against a biasing force between a first position, wherein said flexible tab is in an unflexed state and engageable by the tab engaging feature and a second position wherein said flexible tab is in a flexed state and not engageable by the tab engaging feature, further comprising a spring between said housing and said slider for biasing said slider towards said second housing end.

2. The network plug of claim 1, wherein said spring is mounted in a slot in said housing, wherein said slider comprises at least one finger that depends onto said slot and such that movement of said slider towards said first housing end compresses said spring between said finger and a slot end.

3. The network plug of claim 1, wherein said elongate housing comprises a pair of opposed channels, one along each side of said housing, and wherein said slider comprises a pair of opposed and interconnected rails each configured for sliding within a respective one of said channels.

4. The network plug of claim 3, wherein an end of said tab release member is free, said tab release member is curved away from said housing and further wherein said pair of opposed and interconnected rails are interconnected by a cross brace and such that said tab release member free end is positioned adjacent said cross brace and such that when said slider is moved towards said first housing end, said cross brace engages said tab release member free and causing said flexible tab to flex.

5. The network plug of claim 1, comprising a linkage connecting said first slider end with said tab release member.

6. The network plug of claim 5, wherein said linkage is attached to said first slider end via a first pivot arranged horizontally and at right angles to said elongate housing, and to said tab release member via a second pivot arranged horizontally and at right angles to said elongate housing.

7. The network plug of claim 6, wherein said tab release member comprises a snap fitting and said linkage comprises a link comprising an axle arranged horizontally and at right angles to said elongate housing, said second pivot comprising said axle rotatably engaged by said snap fitting.

8. The network plug of claim 1, wherein said slider is manufactured from stainless steel.

9. The network plug of claim 1, further comprising a pull tab attached to said slider and extending away from said first end.

10. A network cable connectable with a socket comprising a tab engaging feature and a plurality of conductive tines disposed therein, the cable comprising:

a plurality of twisted pairs of conductors;

a cable jacket surrounding said plurality of pairs of conductors;

an elongate housing comprising a first housing end, a second housing end opposite said first housing end and configured for mating with the socket, said second housing end comprising a plurality of terminal contacts disposed along a forward face thereof, each of said terminal contacts terminating a respective one of said twisted pairs of conductors and such that when said second housing end is inserted into said socket each of said terminal contacts comes into contact with a respective one of the tines;

a flexible tab attached to said housing towards said second housing end and comprising a tab release member; and a slider connected at a first slider end to said tab release member, said slider configured for movement along a length of said housing away from said second housing end against a biasing force between a first position, wherein said flexible tab is in an unflexed state and engageable by the tab engaging feature and a second position wherein said flexible tab is in a flexed state and not engageable by the tab engaging feature, wherein said tab release member is curved towards said housing and an end of said tab release member is pivotally attatched to said first slider end.

11. The network cable of claim 10, comprising four (4) twisted pairs of conductors and eight (8) terminal contacts.

* * * * *